US006311973B1

(12) United States Patent
Tanaka et al.

(10) Patent No.: US 6,311,973 B1
(45) Date of Patent: Nov. 6, 2001

(54) PAPER STACKER APPARATUS USED WITH FACSIMILE DEVICE

(75) Inventors: Shuuji Tanaka; Yasuhiro Kawashima; Yasunobu Youda, all of Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/716,402

(22) Filed: Nov. 21, 2000

Related U.S. Application Data

(62) Division of application No. 09/146,425, filed on Sep. 3, 1998, now Pat. No. 6,182,964.

(30) Foreign Application Priority Data

| | | |
|---|---|---|
| Sep. 4, 1997 | (JP) | 9-239660 |
| Sep. 10, 1997 | (JP) | 9-245513 |
| Jun. 12, 1998 | (JP) | 10-165479 |

(51) Int. Cl.[7] ..... B65H 43/04

(52) U.S. Cl. ..... 271/314; 271/199; 271/213; 271/176; 271/265.01; 358/498; 250/559.32

(58) Field of Search ..... 271/176, 265.01, 271/314, 213, 216, 207, 202, 270, 199, 3.16; 358/498; 250/548, 559.32; 198/576, 583

(56) References Cited

U.S. PATENT DOCUMENTS

| | | | | |
|---|---|---|---|---|
| 4,451,027 | * | 5/1984 | Alper | 271/270 |
| 4,958,827 | * | 9/1990 | Kaneko | 271/176 |
| 4,979,730 | * | 12/1990 | Holbrook | 271/270 |
| 5,054,769 | | 10/1991 | Watashi . | |
| 5,128,762 | | 7/1992 | Muramatsu et al. . | |
| 5,790,279 | | 8/1998 | Sakellaropoulos . | |

FOREIGN PATENT DOCUMENTS

| | | | | |
|---|---|---|---|---|
| 525 629 | | 5/1931 | (DE) . | |
| 2 086 860 A | * | 5/1982 | (GB) | 271/3.16 |
| 53-41228 | | 4/1978 | (JP) . | |
| 59-118659 | | 7/1984 | (JP) . | |
| 1-317951 | | 12/1989 | (JP) . | |
| 5-294538A | | 11/1993 | (JP) . | |
| 7-203118 | | 8/1995 | (JP) . | |

* cited by examiner

*Primary Examiner*—H. Grant Skaggs
(74) *Attorney, Agent, or Firm*—Oblon, Spivak, McClelland, Maier & Neustadt, P.C.

(57) ABSTRACT

An apparatus for dropping paper sheets at a predetermined paper-stack position when the paper sheets are ejected from a facsimile device includes a conveyor belt which carries the paper sheets, a housing, containing the conveyer belt, which is detachably installed on the facsimile device where the paper sheets are ejected from the facsimile device such that the conveyor belt extends from a paper outlet of the facsimile device to the predetermined paper-stack position, and a driving motor, driving the conveyor belt to carry the paper sheets, which starts operating about a time when the facsimile device starts a paper-ejection operation thereof and stops operating about a time when the facsimile device stops the paper-ejection operation thereof.

9 Claims, 17 Drawing Sheets

PAPER STACKER APPARATUS USED WITH FACSIMILE DEVICE

This application is a Div. of Ser. No. 09/146,425 filed Sep. 3, 1998 now U.S. Pat. No. 6,182,964.

BACKGROUND OF THE INVENTION

1. Field of the Invention

The present invention generally relates to facsimile devices, and particularly relates to a paper-stacker device which conveys paper sheets from a paper-ejection tray to a desired stack position when the paper sheets are ejected from a facsimile device.

2. Description of the Related Art

FIG. 1 is an illustrative drawing showing a configuration of a wingless-type facsimile device.

The facsimile device of FIG. 1 includes a housing 1, a photosensitive drum 2, a cleaner 3, a electric-charge unit 4, an optical writing unit 5, a development unit 6, a toner magazine 7, a transfer roller 8, a fixation unit 9, a paper-supply cassette 10, conveyor rollers 11, resist rollers 12, paper-ejection rollers 13, a paper-ejection sensor 14, a paper-ejection tray 15, a paper-supply roller 16, a scanner unit 20, a paper-supply tray 21, a read sensor 22, and a paper-ejection tray 23.

The photosensitive drum 2 includes photosensitive material on a surface thereof. The electric-charge unit 4 electrically charges the photosensitive drum 2 to a predetermined voltage level. The optical-writing unit 5 scans a laser beam on the surface of the photosensitive drum 2. The development unit 6 develops an electrostatic latent image formed on the photosensitive drum 2 so as to create a toner image. The toner magazine 7 supplies toner to the development unit 6. The transfer roller 8 is placed in contact with the surface of the photosensitive drum 2. The fixation unit 9 includes a pressure exerting roller and a heat applying roller. The paper-supply cassette 10 stores paper sheets P, and is detachable from the facsimile device. The conveyor rollers 11, the resist rollers 12, and the paper-ejection rollers 13 convey a paper sheet along a paper-sheet path. The paper-ejection sensor 14 is situated before the paper-ejection rollers 13, and detects a paper sheet. The paper-ejection tray 15 is attached to the housing 1, and receives the paper sheets P ejected by the paper-ejection rollers 13.

The scanner unit 20 reads a document, and effects a conversion into an image signal. The scanner unit 20 conveys a document sheet along a document-sheet path after it is placed on the paper-supply tray 21. The scanner unit 20 uses the read sensor 22 to read the document image, and, then, ejects the document sheet onto the paper-ejection tray 25.

In what follows, operations of the facsimile device of FIG. 1 will be explained with regard to image recording on a paper sheet.

A control unit (not shown) of the facsimile device is connected to another facsimile device or the like on a transmission side via a telephone line when a communication circuit is activated in response to a call from a switch board. The control unit then stores images in an image memory when receiving the images transmitted according to predetermined protocols. Further, the control unit loads one page's worth of image data from the image memory to a page memory, and generates driving signals based on the image data stored in the page memory for the purpose of driving the optical-writing unit 5.

The control unit also controls the photosensitive drum 2 to rotate in a direction shown by an arrow upon a start of receiving the image signals, and charges the photosensitive drum 2 up to a predetermined voltage level by use of the electric-charge unit 4. The optical-writing unit 5 emits a laser beam modulated in accordance with the driving signals from the control unit, and scans the laser beam on the photosensitive drum 2 electrically charged at the predetermined voltage level. This creates an electrostatic latent image on the photosensitive drum 2. In association with the rotation of the photosensitive drum 2, the development unit 6 creates a thin layer of toner on a development roller by using the toner supplied from the toner magazine 7, and selectively applies the toner to the electrostatic latent image on the photosensitive drum 2. This develops the electrostatic latent image, and creates a toner image on the photosensitive drum 2.

Upon a start of creating the toner image on the photosensitive drum 2, the paper-supply roller 16 starts rotating, so that a sheet of paper is taken out from the stack of the paper sheets P stored in the paper-supply cassette 10. This paper sheet is conveyed along the paper-sheet path (not shown), and makes a temporal stop when a front end of the paper sheet touches the resist rollers 12. The resist rollers 12 resume the conveyer operation when a front end of the toner image on the photosensitive drum 2 reaches a predetermined position. The transfer roller 8 transfers the toner image from the photosensitive drum 2 to the paper sheet at a position where the transfer roller 8 and the photosensitive drum 2 clamp the paper sheet therebetween.

The paper sheet having the toner image thereon is separated from the photosensitive drum 2 by a separation blade or the like (not shown), and is supplied to the fixation unit 9. The fixation unit 9 applies heat to the toner image while pressure is applied, thereby fixing the toner image on the paper sheet. The paper sheet is ejected from the housing 1 by the mechanism of the paper-ejection rollers 13, and is stacked on the paper-ejection tray 15.

The control unit of the facsimile device loads one page's worth of image data from the image memory to the page memory one after another, and repeats the above operations for image formation until call the received images are printed on the paper sheets P.

The facsimile device as shown in FIG. 1 is generally called a wingless-type facsimile device. The wingless-type facsimile device is designed to save a floor space by avoiding taking up large spaces for the paper-ejection tray 15, the paper-supply tray 21, and the paper-ejection tray 23. Such a design is a response to an increasing need for a reduction of space that is occupied by the device. The wingless-type facsimile device has the paper-ejection tray 15, the paper-supply tray 21, and the paper-ejection tray 23 designed in such a manner that the vertical projection of these trays onto the floor is contained within the vertical projection of the housing 1. That is, these trays are designed not to protrude from the outer limit of the housing 1 in a horizontal direction.

The facsimile device is supposed to receive transmission on its own in the absence of someone's attendance. When no care is taken for a long time such as during a vacation, however, the paper sheets P may accumulate on the paper-ejection tray 15, while nobody is present to take these paper sheets from the tray. The stack of paper sheets on the paper-ejection tray 15, when excessively accumulated, obstructs the paper ejecting operation of the paper-ejection rollers 13, thereby creating such a problem as paper jamming.

In facsimile devices which are not a wingless type, a paper-ejection tray projecting from the housing of the device may be detached before a long period of no attendance. Then, a cardboard box or the like may be placed on the floor where paper sheets are ejected from the housing of the device. This can easily prevent jamming of the paper sheets at a paper outlet of the device, and, also, can avoid spreading of the paper sheets on the floor. The wingless-type facsimile device, on the other hand, has a relatively small vertical distance between the paper outlet and the paper-ejection tray 15, and it is rather difficult to extend the distance because of limitations imposed by the required size and layout of the housing 1. Because of this, jamming of paper sheets cannot be avoided by preventing the excessively large number of paper sheets from being accumulated on the paper-ejection tray 15.

In order to obviate the above-identified problem, Japanese Patent Laid-open Application No. 7-203118, for example, discloses a facsimile device, which directs paper sheets to a different storage than the storage that is ordinarily used for storing paper sheets when a trouble in paper carrying is detected as in the case of paper jamming. This facsimile device, however, needs to have more than one storage, so that such a configuration cannot be applied to the facsimile device as shown in FIG. 1 since the device of FIG. 1 is designed to place paper sheets on a single paper-ejection tray 15 after ejecting paper from the housing 1.

Accordingly, there is a need for a paper-stacker device which can carry paper sheets from a paper-ejection tray to such a place as to pose no obstruction to subsequently ejected paper sheets, and can be easily installed at a position where the paper-ejection tray of the facsimile device is situated.

SUMMARY OF THE INVENTION

Accordingly, it is a general object of the present invention to provide a paper-stacker device which can satisfy the need described above.

It is another and more specific object of the present invention to provide a paper-stacker device which can carry paper sheets from a paper-ejection tray to such a place as to pose no obstruction to subsequently ejected paper sheets, and can be easily installed at a position where the paper-ejection tray of the facsimile device is situated.

In order to achieve the above objective, an apparatus for dropping paper sheets at a predetermined paper-stack position when the paper sheets are ejected from a facsimile device includes a conveyor belt which carries the paper sheets, a housing, containing the conveyer belt, which housing is detachably installed at a position where the paper sheets are ejected from the facsimile device such that the conveyor belt extends from a paper outlet of the facsimile device to the predetermined paper-stack position, and a driving motor, driving the conveyor belt to carry the paper sheets, which driving motor starts operating about a time when the facsimile device starts a paper-ejection operation thereof and stops operating about a time when the facsimile device stops the paper-ejection operation thereof.

According to one aspect of the present invention, the apparatus as described above further includes a power cable which receives a driving current from the facsimile device and supplies the driving current to the driving motor, the driving current being in synchronism with the paper-ejection operation of the facsimile device.

According to another aspect of the present invention, the apparatus as described above is such that the driving current is derived from a driving current which drives paper-ejection rollers of the facsimile device.

According to another aspect of the present invention, the apparatus as first described further includes a control unit, provided in the housing, which control unit receives from the facsimile device a detection signal indicating rotation of paper-ejection rollers of the facsimile device, and controls the driving motor to drive the conveyor belt generally, in synchronism with the rotation of the paper-ejection rollers.

According to another aspect of the present invention, the apparatus as described in the immediately preceding paragraph further includes a roller sensor, provided inside the facsimile device, which roller sensor detects the rotation of the paper-ejection rollers, and supplies the detection signal to the control unit.

According to another aspect of the present invention, the apparatus as described above further includes a power cable which extends from the housing, and is connected to the facsimile device to receive power therefrom, the control unit and the driving motor operating based on the power.

According to another aspect of the present invention, the apparatus as described above is such that the driving current is provided from a control unit of the facsimile device.

According to another aspect of the present invention, the apparatus as described above is such that the driving motor includes an electronic governor motor.

According to another aspect of the present invention, the apparatus as described above is such that the driving motor drives the conveyor belt such that the conveyor belt moves at a faster speed than that of the paper sheets being ejected from the facsimile device.

According to another aspect of the present invention, the apparatus as described above further includes leg parts movably connected to a bottom surface of the housing, the leg parts having lengths thereof respectively adjustable and having positions thereof respectively adjustable along an extension of the conveyor belt.

According to another aspect of the present invention, the apparatus as first described further includes a roller sensor, provided in the facsimile device, which detects rotation of paper-ejection rollers of the facsimile device.

According to another aspect of the present invention, the apparatus as described in the immediately preceding paragraph is such that the roller sensor generates a detection signal changing a signal level thereof in accordance with a rotation rate of the paper-ejection rollers, the apparatus further including a control unit which ascertains a start of the rotation of the paper-ejection rollers when there is a change in the detection signal, and ascertains a stop of the rotation of the paper-ejection rollers when the detection signal shows no change for a first predetermined period of time.

According to another aspect of the present invention, the apparatus as described above is such that the control unit stops the driving motor at an end of a second predetermined period of time following a last change in the detection signal when ascertaining the stop of the paper-ejection rollers.

According to another aspect of the present invention, the apparatus as described above is such that the roller sensor includes an optical sensor emitting light and receiving returning light reflected by an object associated with the paper-ejection rollers.

According to another aspect of the present invention, the apparatus as described above is such that the roller sensor includes a mechanical sensor having a movable part, a position of which is changed through a physical contact with an object associated with the rotation of the paper-ejection rollers.

In the apparatus described above, the paper sheets ejected from the facsimile device are carried by the conveyor belt, and are successively dropped in a paper storage placed at the paper-stack position. Even when no attendance is expected for a long period of time such as during a long vacation season, the paper sheets would not be jammed from an excessive number of the paper sheets being accumulated on a paper-ejection tray go as to obstruct the following paper sheets ejected by paper-ejection rollers.

Further, when the conveyor belt is operated in synchronization with the rotation of the paper-ejection rollers, this results in the last sheet of paper being left on the conveyor belt after this sheet is ejected by the paper-ejection rollers. This last sheet, however, will be dropped in the paper storage at the paper-stack position because of subsequent movement of the conveyor belt starting upon receipt of a next facsimile transmission.

On the other hand, when the conveyor belt continues moving for the second time period even after the paper-ejection rollers stop, the last one of the paper sheets ejected from the facsimile is dropped at the stack position without a failure. This prevents the last sheet from being left on the conveyor belt until the start of a next paper-ejection operation, so that there is no chance of the last sheet getting lost by falling somewhere other than the stack position during the period of no attendance.

Moreover, the device described above is regarded as including the roller sensor as part of the device even when the roller sensor is provided inside the facsimile device. This is a valid view especially when the roller sensor is an optional element that can be attached to or detached from the facsimile device or when the stacker device is provided in conjunction with the facsimile device as an attachment thereto. Nonetheless, facsimile devices having such a roller sensor along with a detection portion and/or a control device as default parts therein may be provided without an attached stacker device. Such facsimile devices are intended to be within the scope of the present invention as set forth in the claims.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

Figure 1:
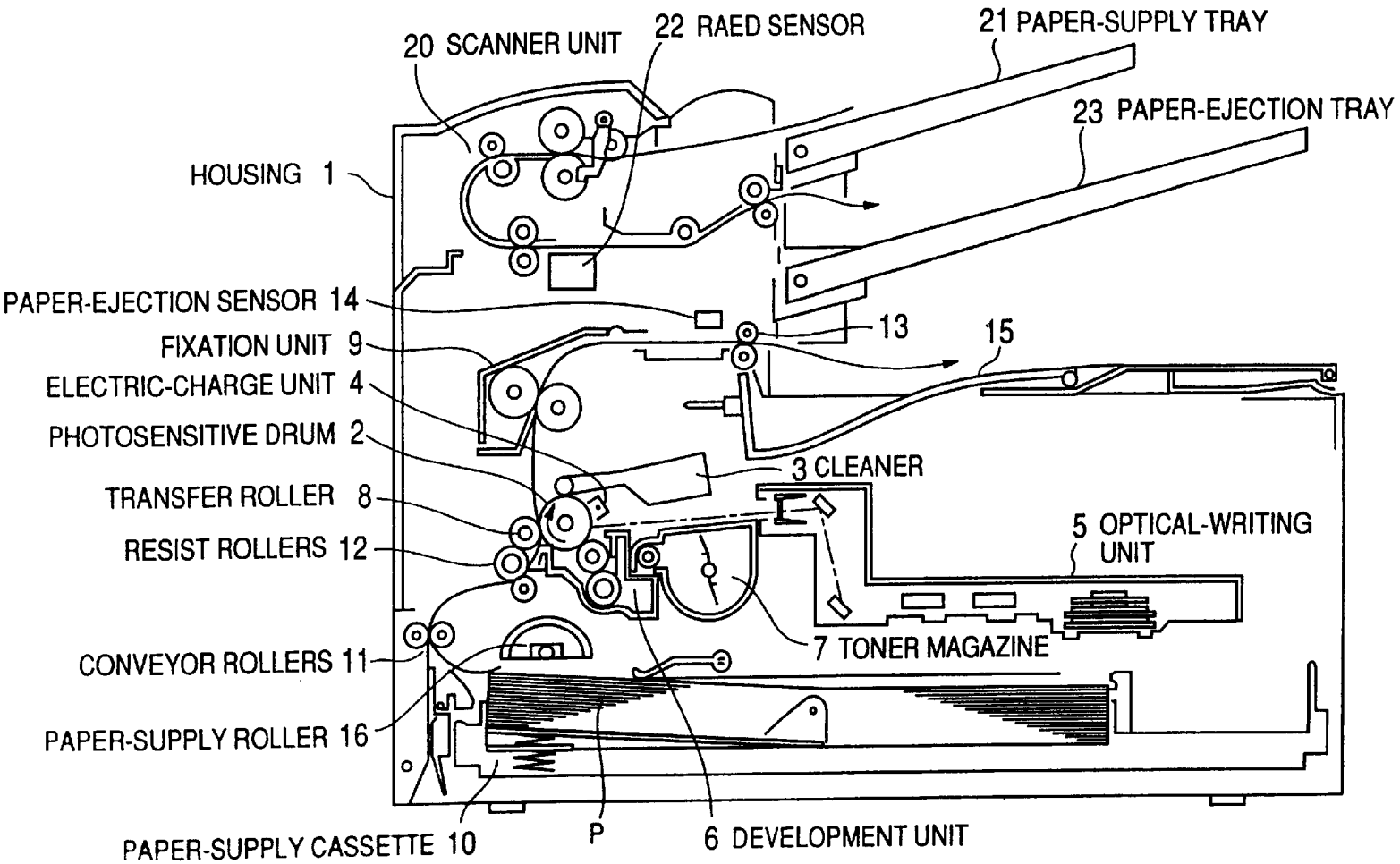
FIG. 1 is an illustrative drawing showing a configuration of a wingless-type facsimile device.
Figure 2:
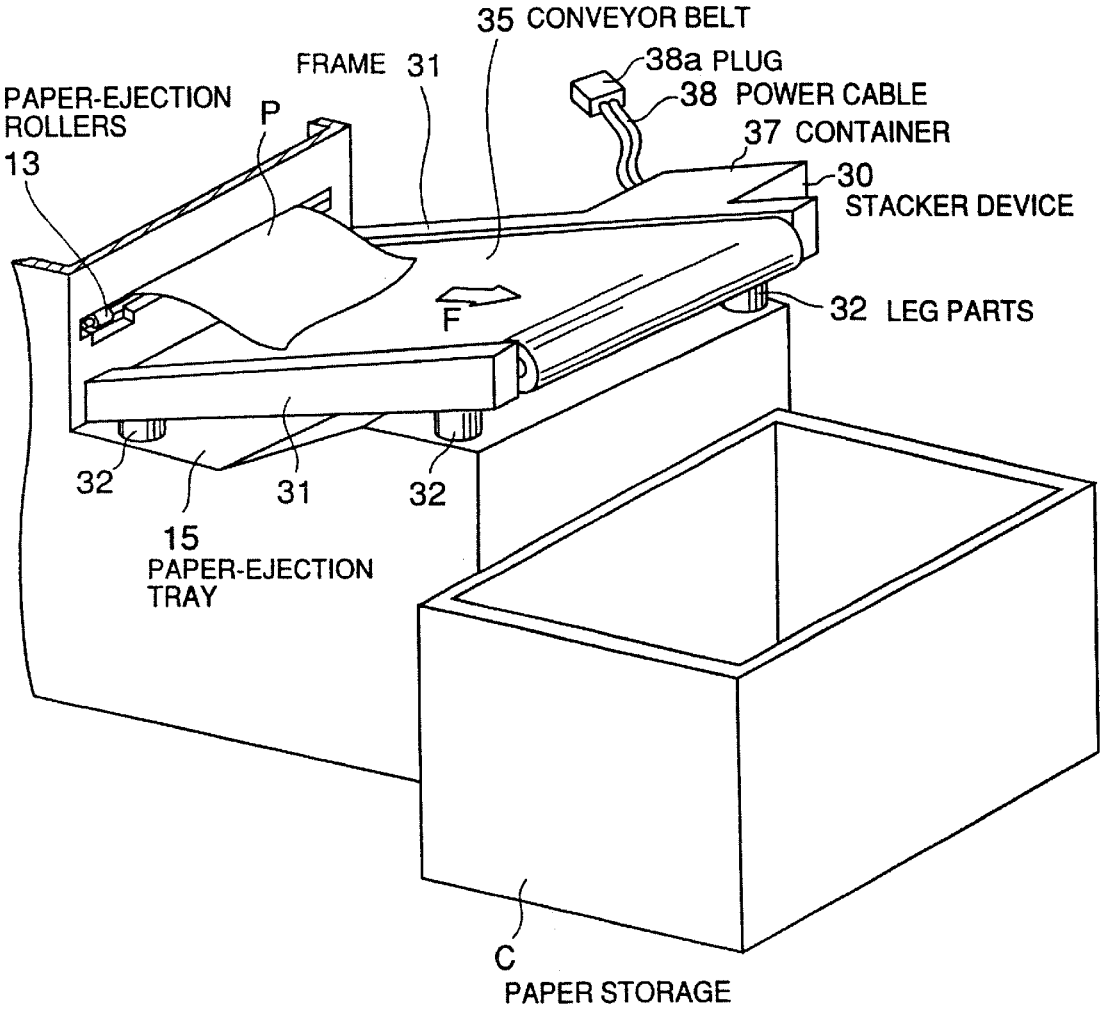
FIG. 2 is an isotropic view of a first embodiment of a stacker device according to the present invention as it appears when installed on a facsimile device.
Figure 3:
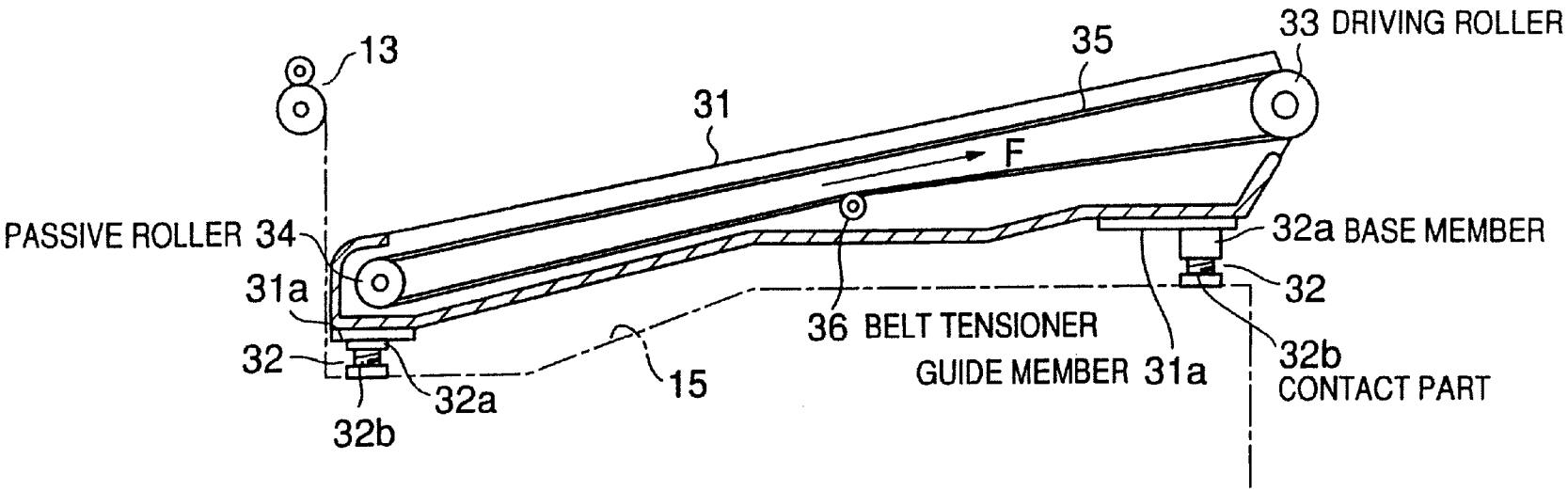
FIG. 3 is a cross-sectional view of the stacker device of FIG. 2 as taken from a side view.
Figure 4:
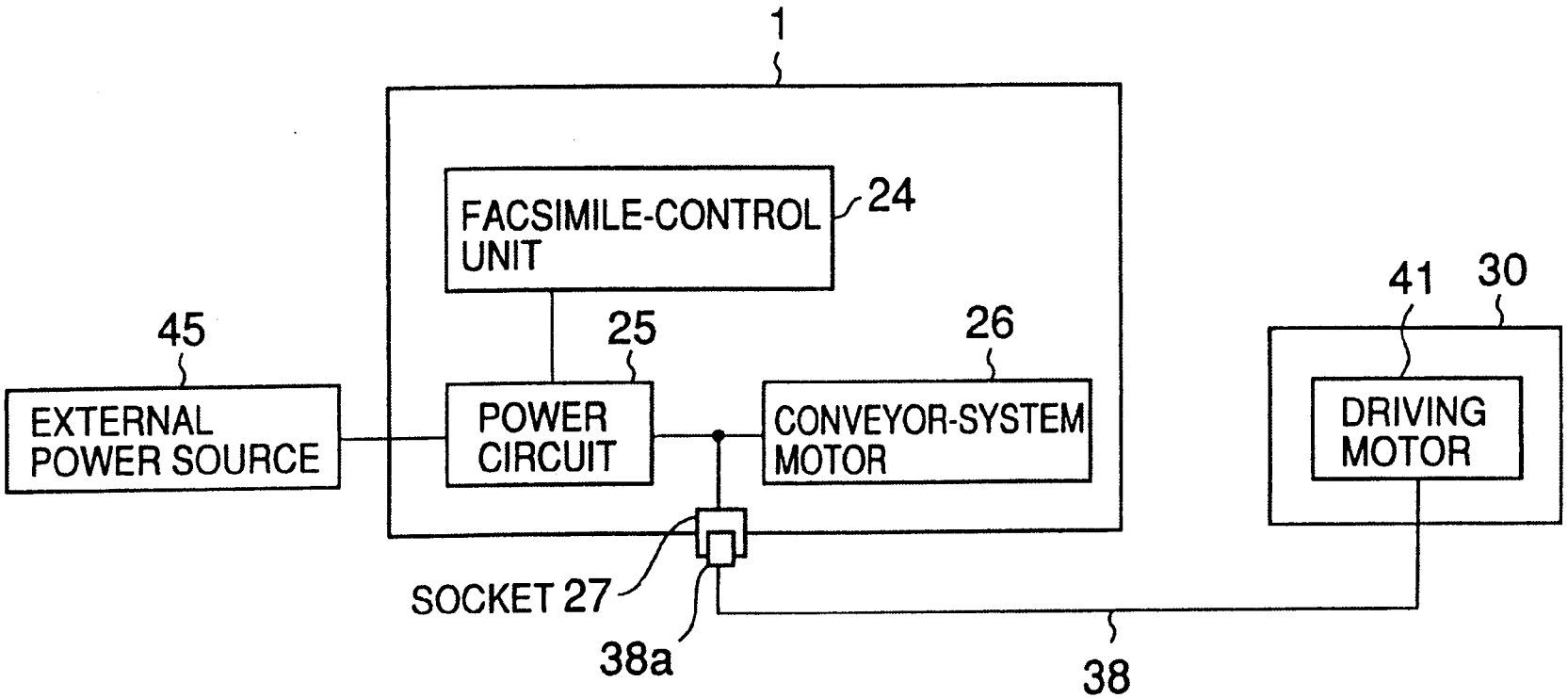
FIG. 4 is a block diagram showing a configuration of the facsimile device on which the stacker device of FIG. 2 can be installed.

FIG. 2 is an isotropic view of a first embodiment of a stacker device according to the present invention as it appears when installed on a facsimile device. FIG. 3 is a cross-sectional view of the stacker device of FIG. 2 as taken from a side view. FIG. 4 is a block diagram showing a configuration of the facsimile device on which the stacker device of FIG. 2 can be installed. The following description will be provided with regard to a case in which the slacker device of this embodiment is used along with the wingless-type facsimile device of FIG. 1.

A stacker device 30 is installed on the paper-ejection tray 15. A frame 31 supports various elements of the device. Leg parts 32 are comprised of a set of four legs arranged at four corners of the frame 31 beneath the bottom surface thereof. As shown in FIG. 3, each of the leg parts 32 includes a base member 32*a* having a screwed hole therein and a contact part 32*b* having a screw fitting into the screwed hole. The contact part 32*b* has a bottom portion thereof made of a soft material in order avoid damaging the paper-ejection tray 15. The contact part 32*b* is rotated relative to the base member 32*a* so as to drive the screw into the screwed hole, thereby making an adjustment with regard to a total length of the leg. The base member 32*a* engages with a guide member 31*a*, which is provided beneath the bottom surface of the frame 31, such that the base member 32*a* is movable along a travel direction of paper sheets (i.e., along a direction in which the paper sheets are conveyed).

A driving roller 33 is rotatable and supported at one end of the frame 31. A passive roller 34 is also rotatable and supported at the other end of the frame 31. A conveyor belt 35 forms an endless loop, and is suspended between the driving roller 33 and the passive roller 34. The conveyor belt 35 is made of an elastic rubber or the like which exhibits a sufficient friction against paper sheets. A belt tensioner 36 is pressed against the conveyor belt 35 with an aim of creating a sufficient tension of the conveyor belt 35. A container 37 is integrally formed with the frame 31, and stores various components as shown in FIG. 4. A power cable 38 extends from the container 37.

In FIG. 4, a driving motor 41 is shown. This driving motor 41 is connected to the driving roller 33 (FIG. 3) via a torque transmission mechanism such as a belt and pulleys, gears, or the like. When a driving electric current is supplied, the driving motor 41 generates a torque for rotating the driving roller 33. The driving motor 41 may be a DC-brushless motor, a stepping motor, an electronic governor motor, or the like. In the stacker device 30 of the first embodiment, an electronic governor motor is used as the driving motor 41. An electronic governor motor does not require a special driving circuit such as that which would be used for a stepping motor, and suffers less fluctuation in a rotation rate when the load is imposed. Because of these, the electronic governor motor can reduce a cost of the stacker device 30, and enhance a reliability of paper-conveyor operations.

Figure 5A:
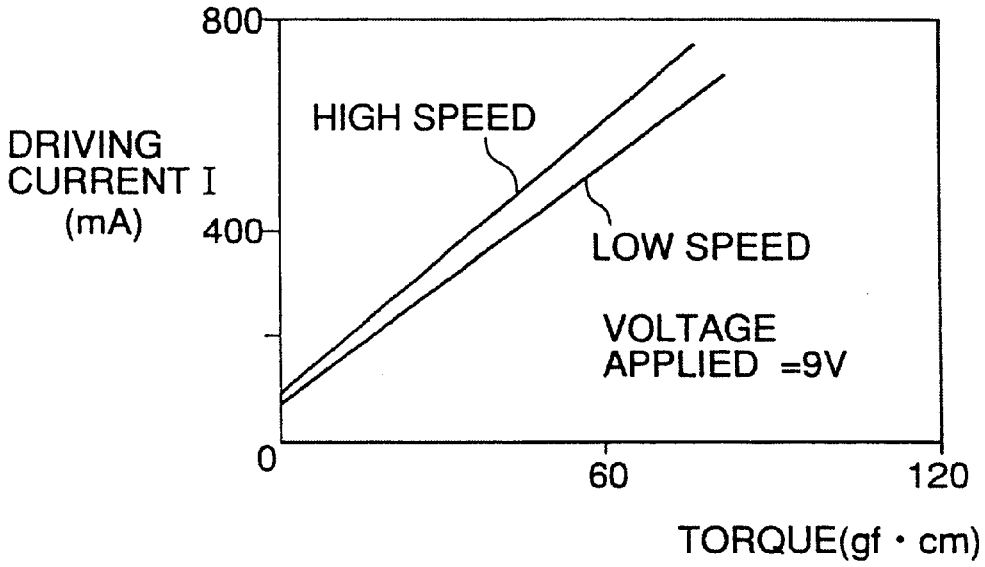
FIGS. 5A and 5B are charts showing characteristics of an electronic governor motor which is applicable to the stacker device of the present embodiment.
Figure 5B:
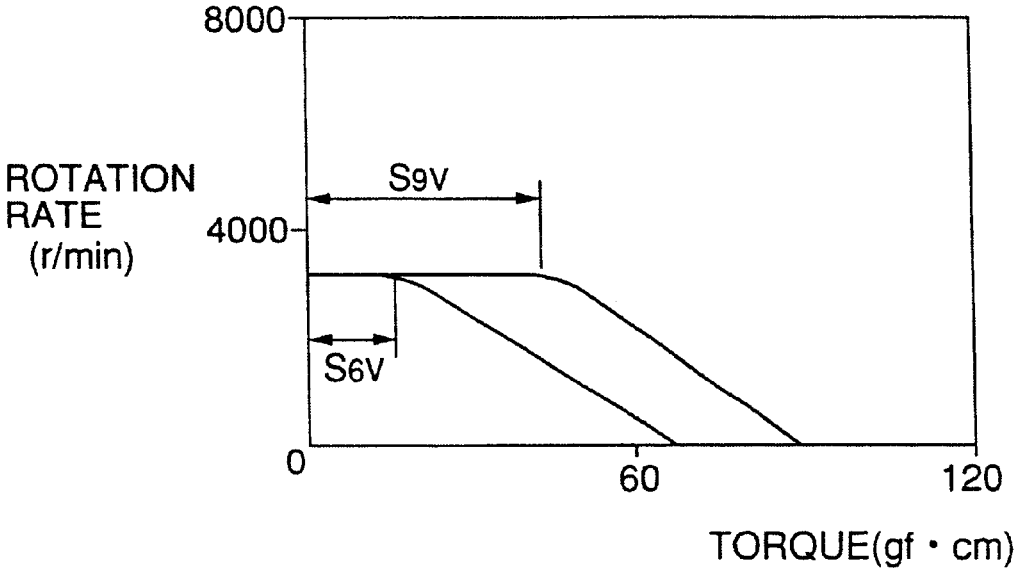

FIGS. 5A and 5B are charts showing characteristics of an electronic governor motor which is applicable to the stacker device of the present embodiment.

FIG. 5A shows that as a driving current I supplied to an electronic governor motor increases, a torque generated by the motor also increases by keeping a linear relation with the amount of the current. FIG. 5B shows that a fluctuation of torque within a range $S_{9V}$ does not affect a constant rotation rate of the motor when an applied voltage is 9V, and further shows that a torque fluctuation within a range $S_{6V}$ does not change the motor rotation rate when the applied voltage is 6V.

The housing 1 of the facsimile device includes a facsimile-control unit 24, a power circuit 25, and a conveyor-system motor 26. The facsimile-control unit 24 takes charge of overall control of the facsimile device. The power circuit 25 converts an alternating current supplied from an external power source 45 into a direct current, and, also, transforms the power voltage into a desired level. The conveyor-system motor 26 generates a torque for rotating various paper-carrier elements such as the paper-ejection rollers 13. The facsimile-control unit 24 activates a signal supplied to the power circuit 25 upon a start of a printing operation with respect to the paper sheets P, and deactivates the signal when the paper-ejection sensor 14 detects an ejection of the last sheet of paper with regard to the received images. The power circuit 25 supplies the driving current to the conveyor-system motor 26 during a time period when the above-noted signal remains activated. Receiving the driving motor, the conveyor-system motor 26 rotates the paper-ejection rollers 13, the photosensitive drum 2, the heat applying roller of the fixation unit 9, etc., which comprise the paper-carrier means for the paper sheets P.

The output of the power circuit 25 is also directed to a branch line positioned before the conveyor-system motor 26, and is supplied to a socket 27 provided on an exterior panel of the housing 1. The socket 27 receives a plug 38*a* inserted therein. The plug 38*a* is connected to the power cable 38, which extends from the stacker device 30 installed on the paper-ejection tray 15. This configuration allows the power cable 38 to supply the driving current from the power circuit 25 to the driving motor 41. Because of this, during a period when the paper-ejection rollers 13 rotate, the driving motor 41 also rotates to move the conveyor belt 35 in the travel direction of paper sheets (as shown by an arrow in FIG. 2).

The stacker device 30 as described above may be installed on the paper-ejection tray 15 of the facsimile device when no attendance is expected for a long period of time as during a vacation or when a large number of images are expected to arrive via facsimile transmissions in a relatively short time period.

The paper-ejection tray 15 is usually provided in a slanted position so as to form a slope rising toward the end of the tray. Since the total lengths of the leg parts 32 and the positions thereof can be adjusted in accordance with the surface slope and length of the paper-ejection tray 15, the stacker device 30 can be securely installed on the paper-ejection tray 15. Such secure installation is achieved regardless of whether the total surface or a portion of the surface has a slope or even when the length of the surface varies depending on the product.

The conveyor belt 35 has a width thereof wider than the width of the largest paper size used for the printing of images in the facsimile device. Further, the conveyor belt 35 has a length along the travel direction of paper sheets such that the end portion of the conveyor belt 35 overhangs from the paper-ejection tray 15 when installed on the paper-ejection tray 15.

The driving motor 41 moves the conveyor belt 35 along the established loop of the conveyor belt 35. The speed of the conveyor belt 35 is slightly higher than the speed at which a paper sheet is ejected by the paper-ejection rollers 13 when the conveyor belt 35 is moved in a paper-conveyor direction (as indicated by an arrow F). Because of the slightly higher speed of the conveyor belt 35, an increase in a surface friction against the paper sheet is prevented when the paper sheet is ejected, and warping of the paper sheet is avoided. This prevents the stacker device 30 from causing jamming of the paper sheet around the paper-ejection rollers 13. A warped paper sheet would render the carrying of the paper sheet unstable since the warped paper sheet would be precariously placed on the conveyor belt 35. Such an unstable carrying condition can also be avoided by the above configuration. In detail, the speed of the conveyor belt 35 may be set to be 1.1–1.5 times faster than the paper-ejection speed of the paper-ejection rollers 13. When a consideration is given to a reduction in power consumption as well as to the load on the driving motor 41, the speed may be preferably 1.1 times the speed of paper ejection.

When the stacker device 30 is installed on the paper-ejection tray 15, as shown in FIG. 2, a paper storage C such as a cardboard box or the like is placed at a position where a paper sheet P is dropped after the conveyor belt 35 carries it. Hereinafter, this position is referred to as a stack position.

By use of the stacker device 30 of the first embodiment as described above, the paper sheets P ejected from the housing 1 of the facsimile device are carried by the conveyor belt 35, and are successively dropped in the paper storage C placed at the stack position. Even when no attendance is expected for a long period of time such as during a long vacation season, the paper sheets P would not be jammed from an excessive number of the paper sheets P being accumulated on the paper-ejection tray 15 so as to obstruct the following paper sheets ejected by the paper-ejection rollers 13. In the stacker device 30 of the first embodiment, the conveyor belt 35 is operated in conjunction with the rotation of the paper-ejection rollers 13. This results in the last sheet of paper being left on the conveyor belt 35 after this sheet is ejected by the paper-ejection rollers 13. This last sheet, however, will be dropped in the paper storage C at the stack position because of subsequent movement of the conveyor belt 35 starting upon receipt of a next facsimile transmission.

Further, the stacker device 30 of the first embodiment uses the power circuit 25 of the facsimile device to supply power to the driving motor 41, and the rotation of the driving motor 41 is controlled in accordance with whether the power is turned on or off. This configuration obviates the need to provide a separate power-supply circuit and a separate control unit in the stacker device 30, and makes it possible to control the stacker device 30 from the facsimile device. Namely, there is no need for the stacker device 30 to have a micro-computer, an alternating/direct-current converter, a transformer, etc., so that the manufacturing cost of the stacker device 30 is relatively low.

Figure 6:
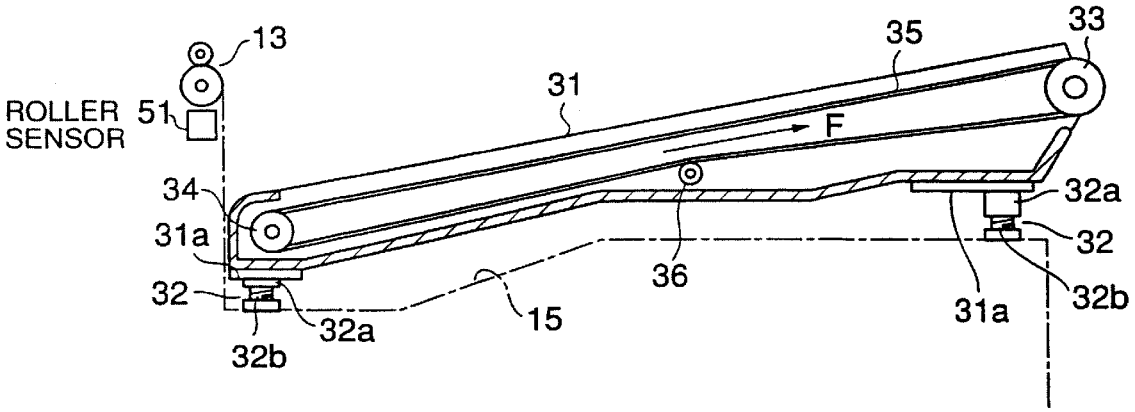
FIG. 6 is a cross-sectional view of a second embodiment of a stacker device according to the present invention.

FIG. 6 is a cross-sectional view of a second embodiment of a stacker device according to the present invention. In FIG. 6, the same elements as those of the first embodiment shown in FIGS. 2 and 3 are referred to by the same numerals, and a description thereof will be omitted. In FIG. 6, a roller sensor 51 is provided to serve as a detection means for detecting rotation of the paper-ejection rollers 13.

Figure 7:
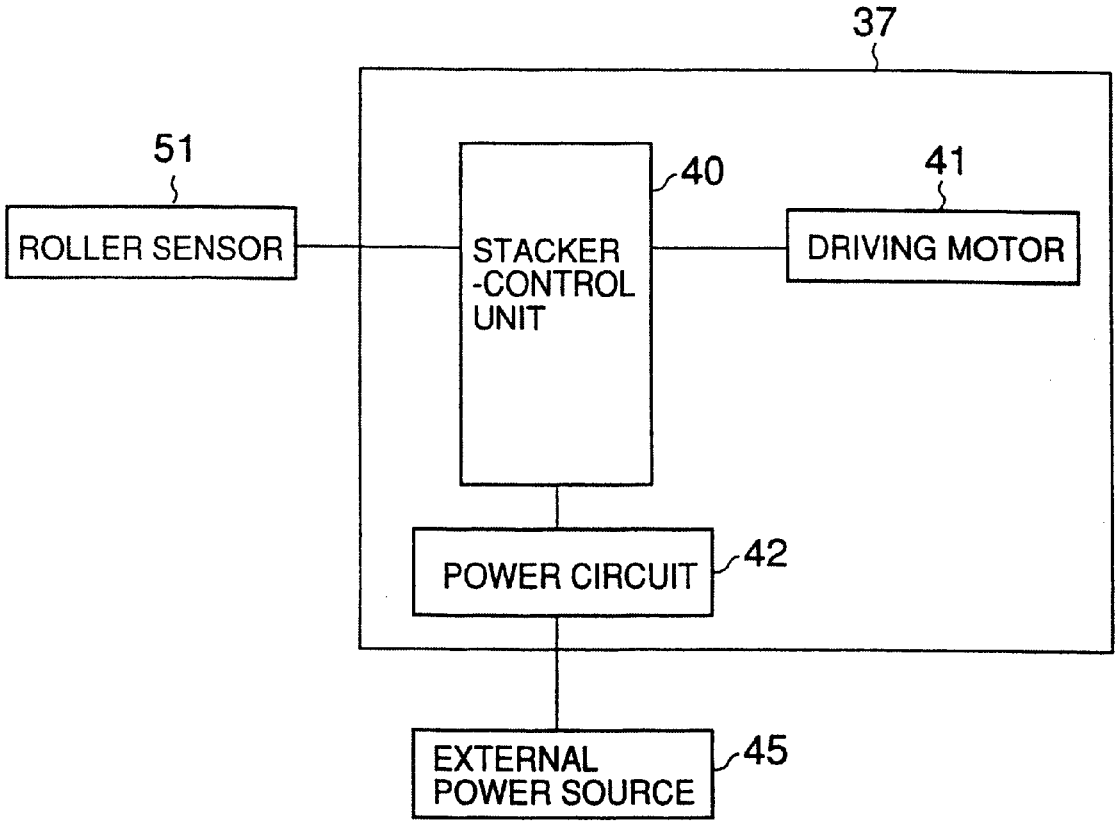
FIG. 7 is a block diagram showing a control unit and a power circuit of the stacker device according to the second embodiment of the present invention.

FIG. 7 is a block diagram showing a control unit and a power circuit of the stacker device according to the second embodiment of the present invention. Elements shown in FIG. 7 are stored in the container 37 of FIG. 2. The power cable 38 extends from the container 37, and is connected to the external power source 45 such as a utility power outlet.

In FIG. 7, the container 37 contains a stacker-control unit 40, the driving motor 41, and a power circuit 42. The driving motor 41 is connected to the driving roller 33 via a torque transmission mechanism such as a belt and pulleys, gears, or the like. The driving motor 41 may be a DC-brushless motor, a stepping motor, an electronic governor motor, or the like. The power circuit 42 converts an alternating current supplied externally into a DC current, and transforms the voltage level to a predetermined voltage. Further, as shown in FIG. 6, the roller sensor 51 is positioned to face the paper-ejection rollers 13, which are situated at the very end of the paper-sheet path inside the housing 1 of the facsimile device. Alternately, the roller sensor 51 may be positioned to face a torque-transmission mechanism of the paper-ejection rollers 13 as will be described later.

The stacker device 30 of the second embodiment as described above is installed on the paper-ejection tray 15 of the facsimile device in the same manner as when the stacker device of the first embodiment is used. That is, the stacker device 30 is installed on the paper-ejection tray 15 when a long period of no attendance is expected during a vacation season or the like or when a large number of images are expected to arrive in a short period of time.

The paper-ejection tray 15 is usually provided in a slanted position so as to form a slope rising toward the end of the tray. Since the total lengths of the leg parts 32 and the positions thereof can be adjusted in accordance with the surface slope and other layout factors of the paper-ejection tray 15, the stacker device 30 can be securely installed on the paper-ejection tray 15. Such secure installation is achieved regardless of whether the total surface or a portion of the surface has a slope.

The conveyor belt 35 has a width thereof wider than the width of the largest paper size used for the printing of images in the facsimile device. Further, the conveyor belt 35 has a length along the travel direction of paper sheets such that the end portion of the conveyor belt 35 overhangs from the paper-ejection tray 15 when installed on the paper-ejection tray 15. The driving motor 41 moves the conveyor belt 35 along the established loop thereof. The speed of the conveyor belt 35 is slightly higher than the speed at which a paper sheet is ejected by the paper-ejection rollers 13 when the conveyor belt 35 is moved in a paper-conveyor direction (as indicated by an arrow F).

When the stacker device 30 is installed on the paper-ejection tray 15, as shown in FIG. 2, the paper storage C such as a cardboard box or the like is placed at a position where a paper sheet P is dropped after the conveyor belt 35 carries it. Hereinafter, this position is referred to as a stack position.

In the stacker device of the second embodiment as described above, the power circuit 42 supplies a driving current to the stacker-control unit 40, and the stacker-control unit 40 controls whether to supply the driving current to the driving motor 41, thereby effecting control of whether to drive the driving motor 41. Respective timings at which the driving motor 41 is activated or deactivated are controlled based on a detection signal that the stacker-control unit 40 obtains from the roller sensor 51. Namely, upon a start of rotation of the paper-ejection rollers 13, the stacker-control unit 40 ascertains that a paper-ejection operation has started to eject the paper sheet P from the housing 1 of the facsimile device. The stacker-control unit 40 activates the driving motor 41 in synchronism with a timing at which the paper-ejection rollers 13 start the rotation thereof. When the paper-ejection rollers 13 stop, the stacker-control unit 40 ascertains that the paper-ejection operation for ejecting the paper sheet P from the housing 1 is halted, and controls the driving motor 41 to end rotating in synchronism with a timing at which the paper-ejection rollers 13 stop.

Figure 8:
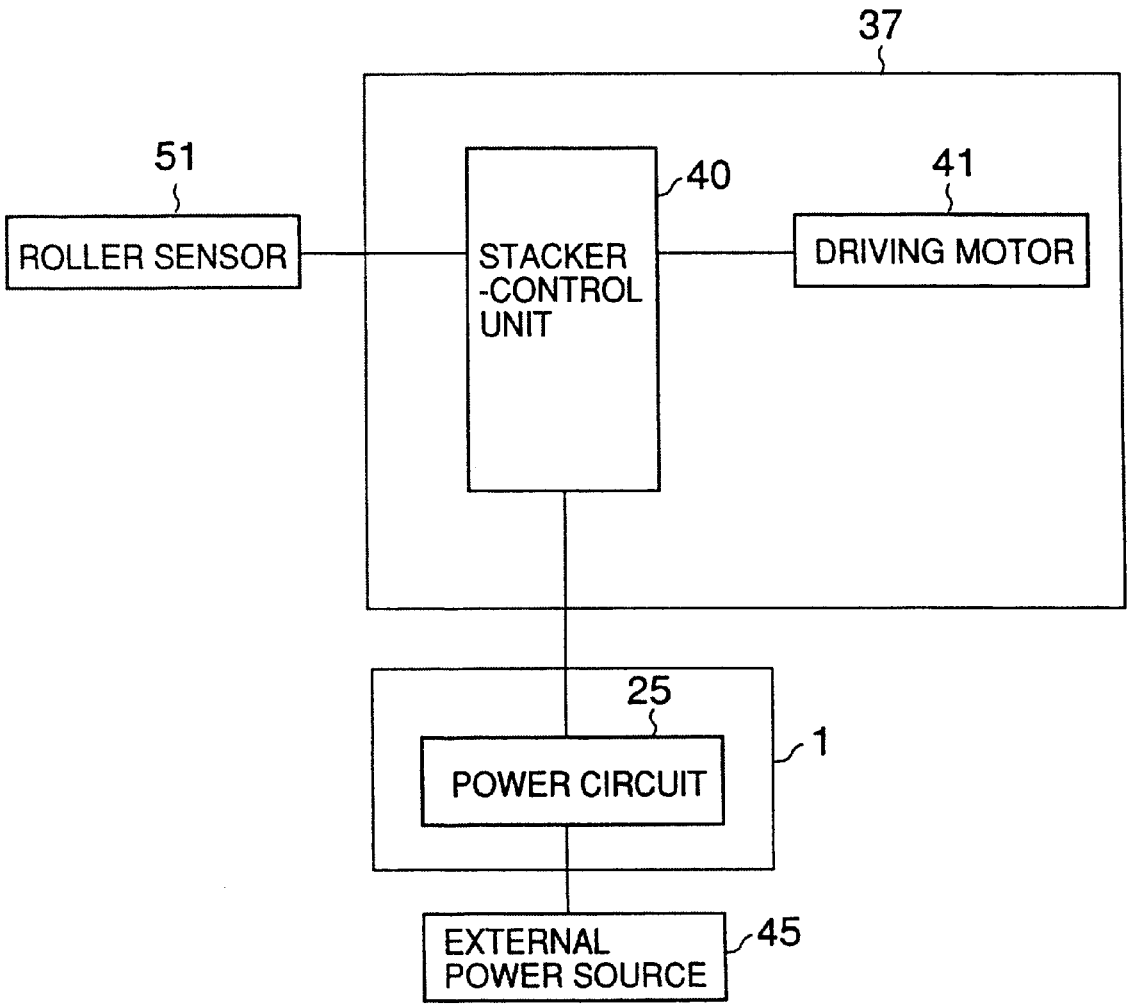
FIG. 8 is a block diagram showing another configuration of the stacker device according the second embodiment of the present invention.

FIG. 8 is a block diagram showing another configuration of the stacker device according the second embodiment of the present invention. In the configuration of FIG. 8, the power circuit 25 for supplying the driving current to the stacker-control unit 40 is provided in the housing 1 of the facsimile device. The power circuit 25 converts an alternating current supplied from the external power source 45 into a direct current, and attends to a voltage transformation into a predetermined voltage, thereby generating the driving current. This configuration eliminates a need to provide a power circuit in the stacker device 30 separately from the facsimile device, yet can provide the driving current to the stacker device 30. Because of this, there is no need for equipping the stacker device 30 with an alternating/direct-current converter, a voltage transformer, etc., so that a manufacturing cost of the stacker device 30 can be lower than it would otherwise be.

Figure 9:
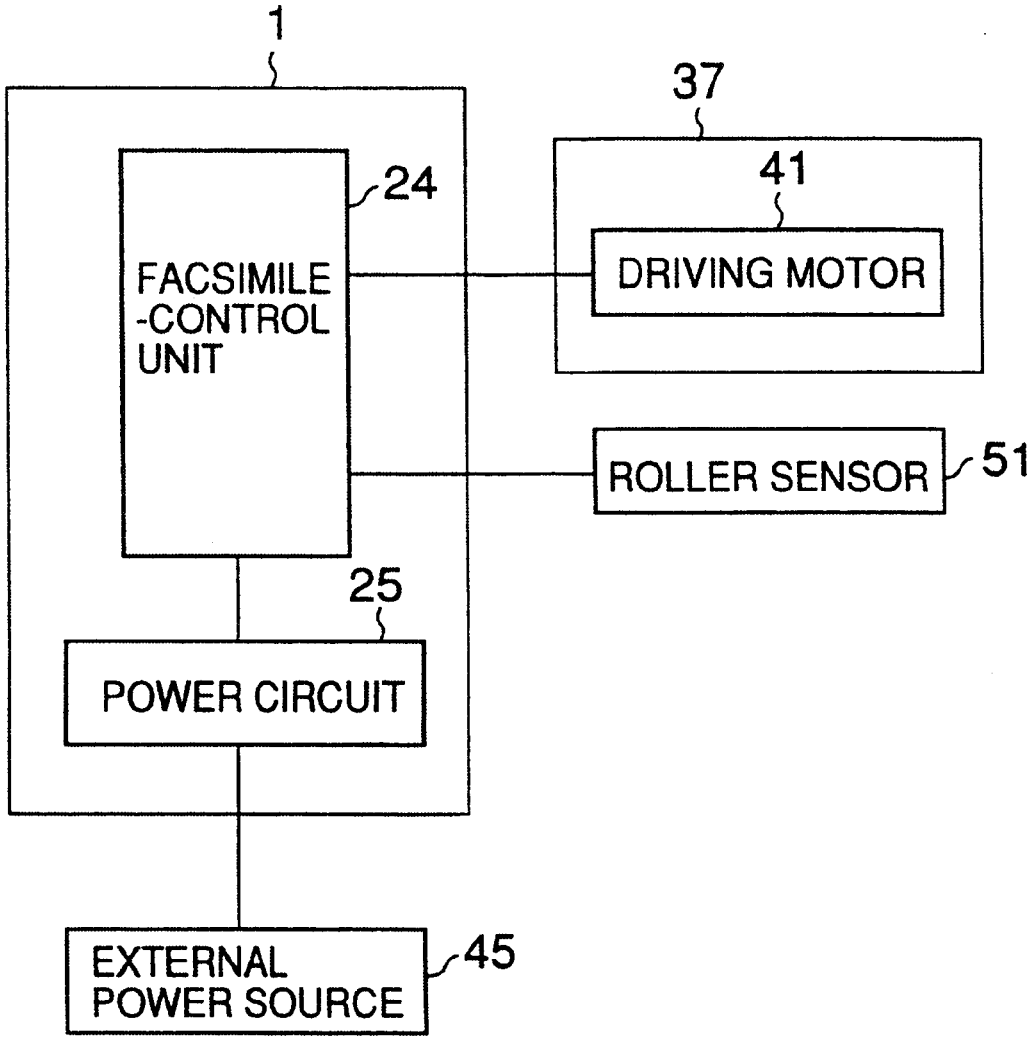
FIG. 9 is a block diagram showing yet another configuration of the stacker device according the second embodiment of the present invention.

FIG. 9 is a block diagram showing another configuration of the stacker device according the second embodiment of the present invention. In the configuration of FIG. 9, the power circuit 25 provided in the housing 1 of the facsimile device converts an alternating current into a direct current when receiving the alternating current from the external power source 45, and attends to a voltage conversion into a predetermined voltage level, thereby generating a driving signal supplied to the facsimile-control unit 24. The facsimile-control unit 24 is equipped with a function to control the overall operation of the facsimile device as wall as the operation of the stacker device 30 installed on the facsimile device, and performs the same control as that of the stacker-control unit 40 with respect to the stacker device 30 so as to start or stop rotation of the driving motor 41. This configuration eliminates a need to equip the stacker device 30 with a control unit and a power unit separately from the facsimile device, yet achieves a proper control of the stacker device 30 and provides a proper power to the stacker device 30. Because of this, there is no need for equipping the stacker device 30 with a micro-computer, an alternating/direct-current converter, a voltage transformer, etc., so that a manufacturing cost of the stacker device 30 can be further lowered.

Figure 10:
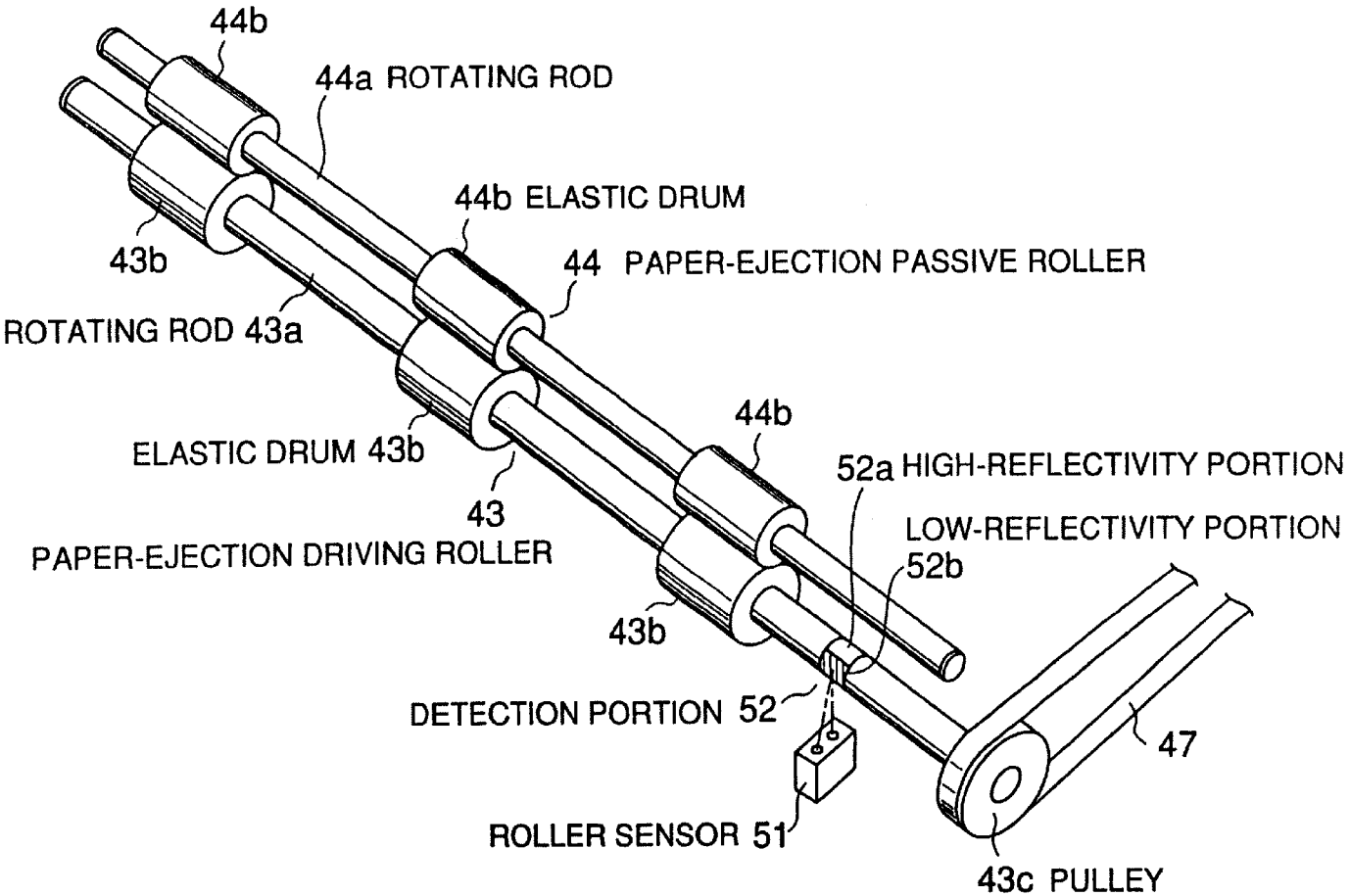
FIG. 10 is an isometric view of a roller sensor and paper-ejection rollers provided in the stacker device according to the second embodiment of the present invention.

FIG. 10 is an isometric view of the roller sensor and the paper-ejection rollers provided in the stacker device according to the second embodiment of the present invention. The roller sensor 51 is comprised of a reflection-type optical sensor including a light emitting device and a light receiving device. For example, the sensor may be a photo coupler in which a light emitting diode is used as the light emitting device, and a photo transistor is used as a light receiving device.

The paper-ejection rollers 13 include a paper-ejection driving roller 43 which is rotated by a torque transmitted from the driving motor 41, and further include a paper-ejection passive roller 44 which is placed in contact with the paper-ejection driving roller 43 to rotate in a passive manner. The paper-ejection driving roller 43 includes a rotating rod 43*a*, elastic drums 43*b*, and a pulley 43*c*. The rotating rod 43*a* is rotatably supported by a pair of rotating-rod-support members (not shown) provided in the housing 1. Each of the elastic drums 43*b* has a cylindrical shape surrounding the rotating rod 43*a*. The pulley 43*c* is fixedly attached to one end of the rotating rod 43*a*. The pulley 43*c* is mechanically connected via a belt 47 to another pulley (not shown) that is fixedly attached to a rotating rod of the driving motor.

The paper-ejection passive roller 44 includes a rotating rod 44*a* and elastic drums 44*b*. The rotating rod 44*a* is rotatably supported by a pair of rotating-rod-support members (not shown) provided in the housing 1. Each of the elastic drums 44*b* has a cylindrical shape surrounding the rotating rod 44*a*. The elastic drums 43*b* of the paper-ejection driving roller 43 and the elastic drums 44*b* of the paper-ejection passive roller 44 are made of an elastic material such as elastic rubber or the like, and the rotating rods 43*a* and 44*a* are positioned such that two drums forming a pair are pressed against each other.

The rotating rod 43*a* has a detection portion 52 on the rod surface thereof, and the detection portion 52 is used by the roller sensor 51 to detect whether the paper-ejection driving roller 43 is rotating or stays still. The detection portion 52 includes a high-reflectivity portion 52*a* and a low-reflectivity portion 52*b* provided at different circumferential positions of the rotating rod 43*a*. The high-reflectivity portion 52*a* and the low-reflectivity portion 52*b* have a difference in reflectivity larger than a predetermined margin.

In order to provide such a detection portion 52 on the rotating rod 43*a*, a tape having a white-color portion and a black-color portion arranged in a longitudinal direction thereof may be wrapped around the rotating rod 43*a*. In this manner, the white-color portion acts as the high-reflectivity portion 52*a*, and the black-color portion serves as the low-reflectivity portion 52*b*. Alternately, if the reflectivity of the surface of the rotating rod 43*a* is sufficiently high, a black-color tape may be attached to the rotating rod 43*a* so as to serve as the low-reflectivity portion 52*b*, and a remaining exposed portion of the surface of the rotating rod 43*a* is used as the high-reflectivity portion 52*a*. Alternately, a high-reflectivity tape having a metallic-like surface may be attached to the rotating rod 43*a* as the high-reflectivity portion 52*a*, and a remaining exposed portion of the surface of the rotating rod 43*a* may be used as the low-reflectivity portion 52*b*.

The roller sensor 51 is situated to face the detection portion 52 provided on the rotating rod 43*a*. A sensitivity level of the roller sensor 51 is set such that a switch mechanism provided therein is turned on when intense light reflected by the high-reflectivity portion 52*a* is received, and is turned off when less intense light is received from the low-reflectivity portion 52*b*. A detection signal output from the roller sensor 51 takes one of two binary values, becoming HIGH when the switch is turned on and LOW when the switch is turned off.

In the following, a paper-conveyor operation of the paper sheet P will be described where the stacker device 30 has a configuration as described above.

Figure 24:
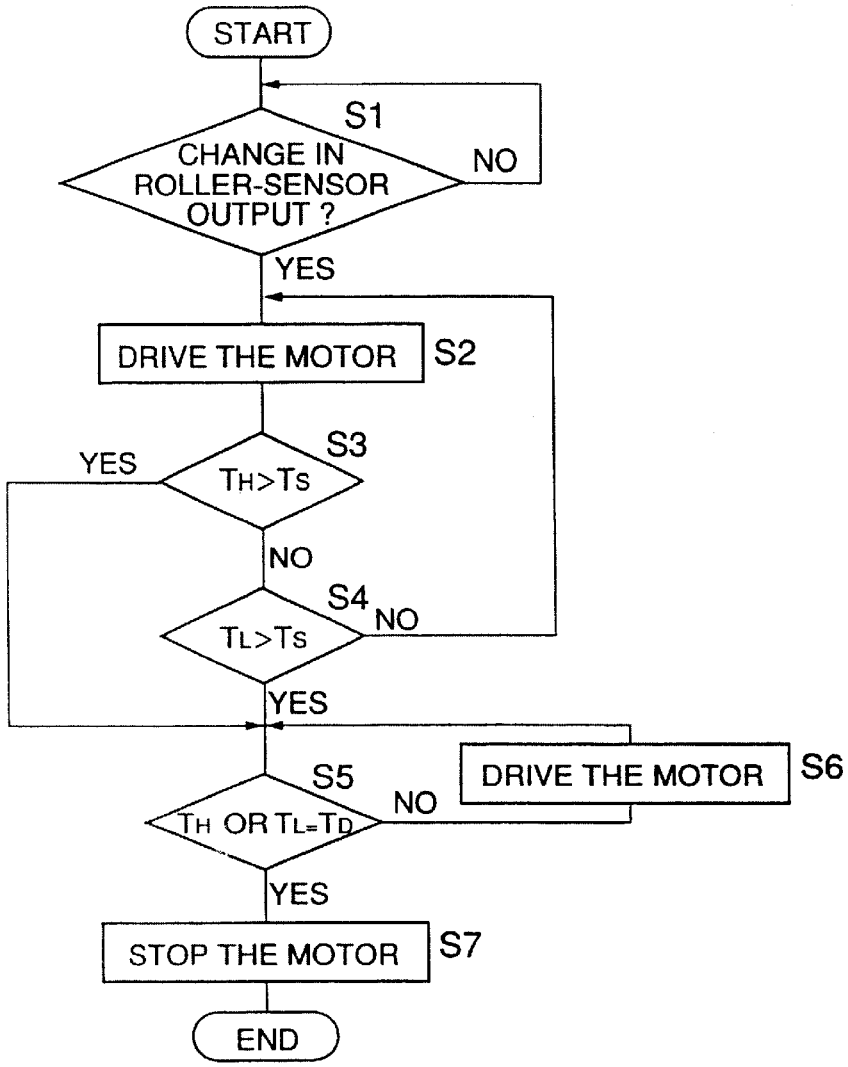
FIG. 24 is a flowchart for explaining a method of controlling the stacker device of the second embodiment.
Figure 25:
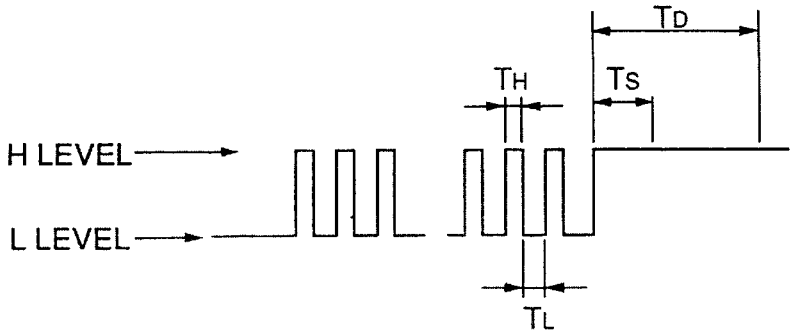
FIG. 25 is a chart showing an example of a detection signal output from the roller sensor of the stacker device according to the second embodiment.

FIG. 24 is a flowchart for explaining a method of controlling the stacker device of the second embodiment. FIG. 25 is a chart showing an example of the detection signal output from the roller sensor of the stacker device according to the second embodiment.

The stacker-control unit 40 or the facsimile-control unit 24 (hereinafter simply referred to as the control unit 40 or 24) constantly monitors the detection signal supplied from the roller sensor 51. When the detection signal output from the roller sensor 51 changes from HIGH to LOW or from LOW to HIGH (i.e., a check at step S1 in FIG. 24 gives an affirmative answer), the control unit 40 or 24 controls the driving motor 41 to start rotating in synchronism with the change in the detection signal (step S2). A timing at which the driving motor 41 commences the rotation thereof may be concurrent with the timing at which a change in the detection signal is detected, or may be delayed behind the latter timing by a predetermined time period, which is no longer than a time lag from the commencement of the rotation of the paper-ejection driving roller 43 to the actual ejection of a paper sheet P.

Further, the control unit 40 or 24 sets a timer (not shown) to start counting time upon a change from LOW to HIGH or from HIGH to LOW in the detection signal of the roller sensor 51, and measures a time period TH during which the detection signal maintains the HIGH level thereof or a time period TL during which the detection signal remains at the LOW level. If the time period TH or the time period TL is longer than a predetermined threshold time period TS (i.e., when an affirmative answer is obtained at step S3 or step S4), it is determined that the paper-ejection driving roller 43 has stopped rotation thereof. In response to this determination, the control unit 40 or 24 stops the rotation of the driving motor 41 after letting the driving motor 41 rotate until an end of a predetermined time period TD starting from the last change of the detection signal (steps S5 through S7).

The time period TD described above may be longer than a time period which is required for the conveyor belt 35 to carry and drop a paper sheet P at the stack position when the paper sheet P is ejected as a last sheet of paper prior to the stop of the paper-ejection driving roller 43. In detail, the time period TD may be equal to such a duration as allowing the conveyor belt 35 to move a distance equivalent to half the entire loop thereof. Since the conveyor belt 35 continues moving for the time period TD even after the paper-ejection driving roller 43 stops, the paper sheet P ejected from the housing 1 is dropped at the stack position without a failure. This prevents the paper sheet P from being left on the conveyor belt 35 until the start of a next paper-ejection operation, so that there is no chance of the paper sheet P getting lost by falling somewhere other than the stack position during the period of no attendance.

FIGS. 11 through 14 are illustrative drawings showing other examples of the detection portion applicable to the stacker device of the second embodiment.

Figure 11:
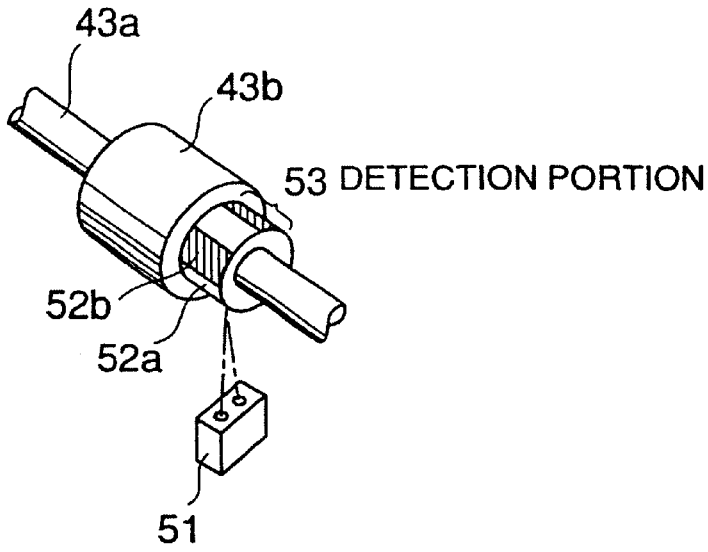
FIGS. 11 through 14 are illustrative drawings showing examples of the detection portion applicable to the stacker device of the second embodiment.

A detection portion 53 of FIG. 11 is provided on a surface of the elastic drum 43*b* attached to the paper-ejection driving roller 43. Similarly to the detection portion 52 shown in FIG. 10, the detection portion 53 includes the high-reflectivity portion 52*a* and the low-reflectivity portion 52*b* provided at different circumferential positions of the elastic drum 43*b*. If the detection portion 53 is provided on the surface of the elastic drum 43*b* in a straightforward manner, the detection portion 53 may interfere with the paper sheet P or the elastic drum 44*b* of the paper-ejection passive roller 44. In order to avoid this, a portion of the elastic drum 43*b* where the detection portion 53 is provided has a smaller diameter. This prevents the detection portion 53 from wearing out or getting dirt thereon due to the physical contact with the paper sheet P and the elastic drum 44*b*.

Figure 12:
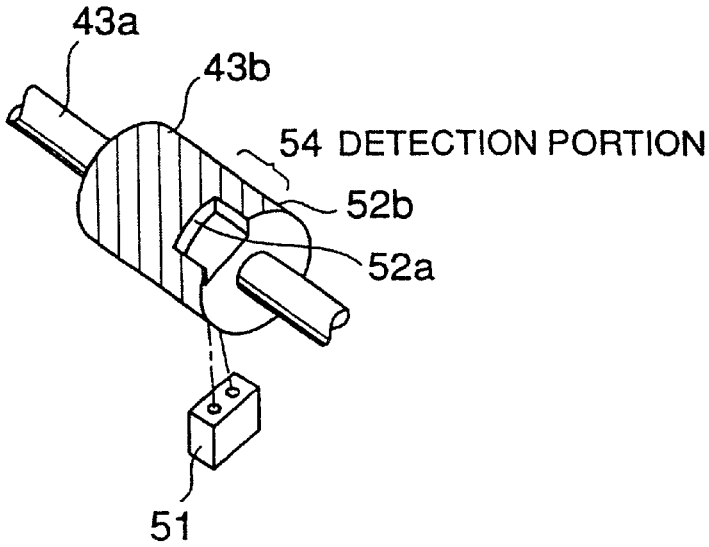

A detection portion 54 of FIG. 12 is provided on the surface of the elastic drum 43*b* attached to the paper-ejection driving roller 43. Similarly to the detection portion 52 shown in FIG. 10, the detection portion 54 includes the high-reflectivity portion 52*a* and the low-reflectivity portion 52*b* provided at different circumferential positions of the elastic drum 43*b*. If the detection portion 54 is provided on the surface of the elastic drum 43*b* in a straightforward manner, the detection portion 54 may interfere with the paper sheet P or the elastic drum 44*b* of the paper-ejection passive roller 44. In order to avoid this, the high-reflectivity portion 52*a* is provided in a recess formed in the elastic drum 43*b*, so that the high-reflectivity portion 52*a* does not come in contact with the paper sheet P or the elastic drum 44*b* of the paper-ejection passive roller 44. In detail, a white-color tape may be attached to the caved surface of the recess so as to serve as the high-reflectivity portion 52*a*. Further, the surface of the elastic drum 43*b* may be designed to have a black color or the like, thereby acting as the low-reflectivity portion 52*b*.

Figure 13:
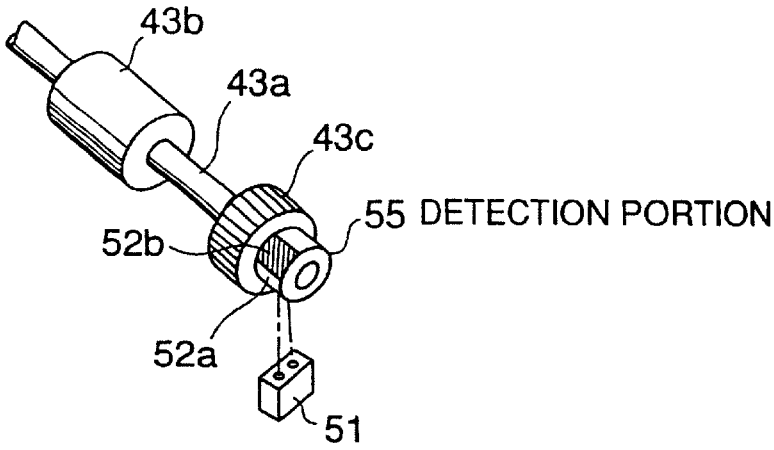

A detection portion 55 of FIG. 13 is formed integrally with the pulley 43*c* fixedly attached to the end of the rotating rod 43*a*. The detection portion 55 having a ring shape extends from a side surface of the pulley 43*c* along an extension of the rotating rod 43*a*. A perimeter surface of the detection portion 55 has the high-reflectivity portion 52*a* and the low-reflectivity portion 52*b* provided at different circumferential positions in the same manner as provided on the detection portion 52 of FIG. 10. In the stacker device of this embodiment, the torque-transmission mechanism has been described as transmitting the torque of the driving motor 41 via the pulley 43*c* and the belt 47. Alternately, the torque-transmission mechanism may be comprised of a series of gears. In this case, the detection portion 55 as shown in FIG. 13 may be integrally formed with a gear which is fixedly attached to the end of the rotating rod 43*a*. Such a configuration can properly detect the rotation of the paper-ejection driving roller 43 by use of the roller sensor 51.

Figure 14:
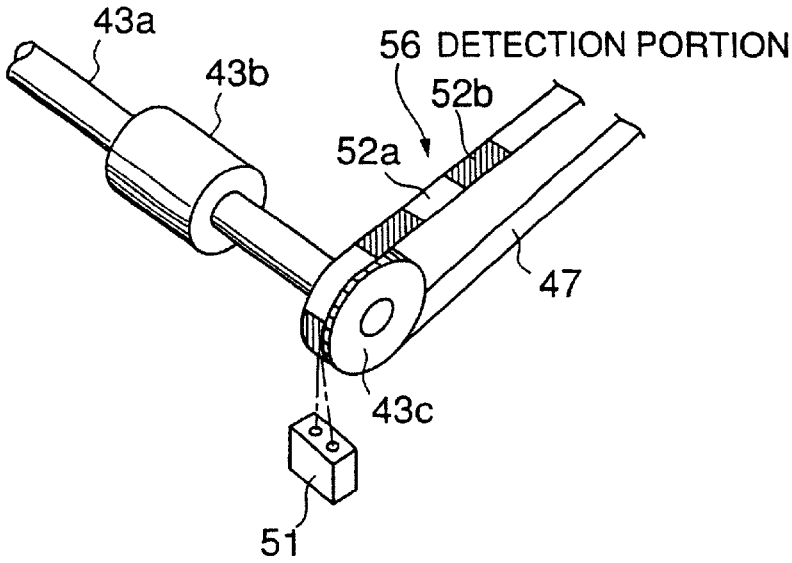

A detection portion 56 of FIG. 14 is provided on an outer surface of the belt 47, which is looped around and suspended between the pulley 43*c* and the driving motor 41. Similarly to the detection portion 52 shown in FIG. 10, the detection portion 56 has the high-reflectivity portion 52*a* and the low-reflectivity portion 52*b*, which are provided at different positions along the extension of the belt 47.

Figure 15A:
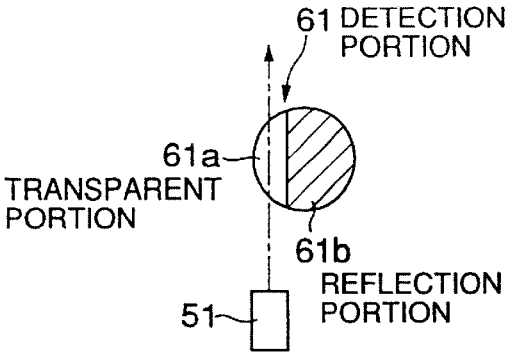
FIGS. 15A and 15B are illustrative drawings showing yet other examples of the detection portion applicable to the stacker device of the second embodiment.
Figure 15B:
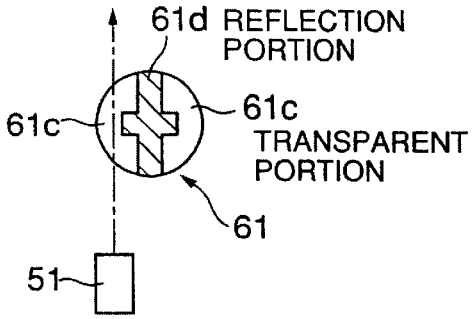

FIGS. 15A and 15B are illustrative drawings showing yet other examples of the detection portion applicable to the stacker device of the second embodiment.

A detection portion 61 of FIG. 15A or 15B is provided as part of the rotating rod 43*a*. The detection portion 61 of FIG. 15A is formed by cutting off a portion of the rotating rod 43*a* such that a cross section taken along a diameter of the rotating rod 43*a* lacks the removed portion. This creates a transparent portion 61*a* and a reflection portion 61*b* as shown in FIG. 15A. A detection portion 61 of FIG. 15B is created by substantially fashioning a cross section of the rotating rod 43*a* as a cross shape, thereby providing a transparent portion 61*c* and a reflection portion 61*d*. Since the detection portion 61 of FIG. 15B has a complex shape, it may not be easy to shape the rotating rod 43*a* in such a manner if the rotating rod 43*a* is made of metal. If the rotating rod 43*a* is made of a resin or the like shaped by a mold, such a cross-sectional shape is easy to create without employing complex manufacturing or process steps.

The roller sensor 51 is situated to face the detection portion 61 of the rotating rod 43*a*. The switch mechanism inside the roller sensor 51 is turned off when light emitted from the light emitting device passes through the transparent portion 61*a* or the transparent portion 61*c*, and is turned on when the light is reflected by the reflection portion 61*b* or the reflection portion 61*d* to be detected by the light receiving device. As previously described, the detection signal becomes HIGH when the switch mechanism is turned on, and becomes LOW when the switch mechanism is turned off.

Figure 16:
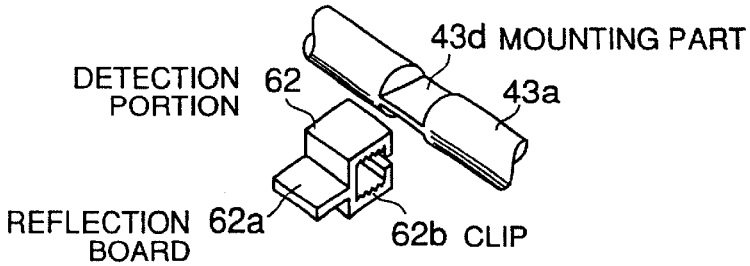
FIG. 16 is an illustrative drawing showing yet another example of the detection portion applicable to the stacker device of the second embodiment.

FIG. 16 is an illustrative drawing showing yet another example of the detection portion applicable to the stacker device of the second embodiment.

A detection portion 62 of FIG. 16 includes a reflection board 62*a* and a clip 62*b* integrally formed as one piece, and is attached to a mounting part 43*d* provided as part of the rotating rod 43*a*. The mounting part 43*d* of the rotating rod 43*a* has two flat surfaces parallel to each other, and is formed by cutting off respective portions of the rotating rod 43*a*. The clip 62*b* is fixed to the mounting part 43*d* so as to fixedly attach the detection portion 62 to the rotating rod 43*a*. In this fixed position, the detection portion 62 has the reflection board 62*a* projecting from the perimeter surface of the rotating rod 43*a*.

The roller sensor 51 is situated to face the reflection board 62*a* when the reflection board 62*a* comes to an appropriate position via the rotation of the rotating rod 43*a*. The switch mechanism inside the roller sensor 51 is turned on when light emitted from the light emitting device is reflected by the reflection board 62*a* situated at the appropriate position so as to enter the light receiving device, and is turned off when the reflection board 62*a* is not in a proper position. As previously described, the detection signal becomes HIGH when the switch mechanism is turned on, and becomes LOW when the switch mechanism is turned off. Since it is easy to attach or detach the detection portion 62 to or from the rotating rod 43*a*, the detection portion 62 can be implemented as a unit together with the roller sensor 51, such that the unit in its entirety can be detachable from the housing 1. This configuration permits a selection between the use of the stacker device 30 or no use of the stacker device 30, thereby making it possible to treat the stacker device 30 as an optional device.

Figure 17:
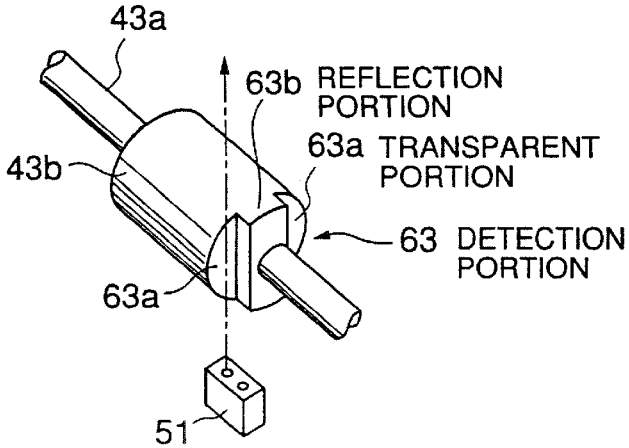
FIG. 17 is an illustrative drawing showing still another example of the detection portion applicable to the stacker device of the second embodiment.

FIG. 17 is an illustrative drawing showing still another example of the detection portion applicable to the stacker device of the second embodiment.

A detection portion 63 of FIG. 17 is provided as part of the elastic drum 43*b*. The detection portion 63 has a transparent portion 63*a* and a reflection portion 63*b*, which are defined by two flat surfaces parallel to each other formed by cutting off respective portions of the elastic drum 43*b*. The roller sensor 51 is positioned to face the detection portion 63 of the elastic drum 43*b*. The switch mechanism inside the roller sensor 51 is turned off when light emitted from the light emitting device passes through the transparent portion 63*a*, and is turned on when the light is reflected by the reflection portion 63*b* to be detected by the light receiving device. As previously described, the detection signal becomes HIGH when the switch mechanism is turned on, and becomes LOW when the switch mechanism is turned off.

Figure 18:
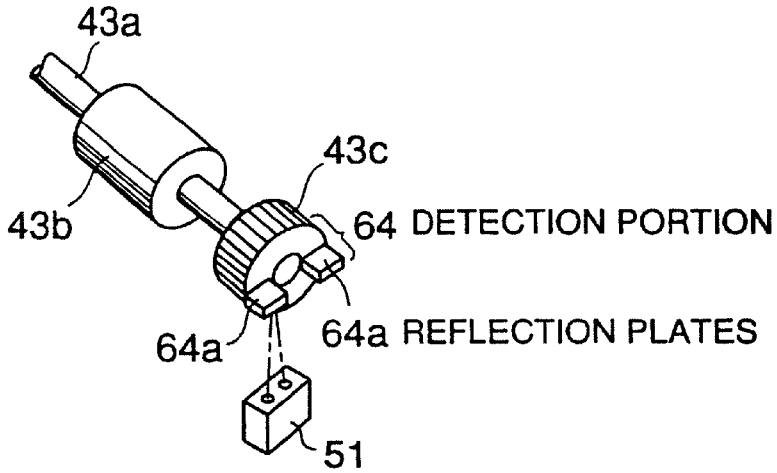
FIG. 18 is an illustrative drawing showing still another example of the detection portion applicable to the stacker device of the second embodiment.

FIG. 18 is an illustrative drawing showing still another example of the detection portion applicable to the stacker device of the second embodiment.

A detection portion 64 of FIG. 18 includes a pair of reflection plates 64*a* extending from a side surface of the pulley 43*c* along an extension of the rotating rod 43*a*. The roller sensor 51 is positioned to face one of the reflection plates 64*a* when this reflection plate comes to an appropriate detection position. The switch mechanism inside the roller sensor 51 is turned on when light emitted from the light emitting device is reflected by one of the reflection plates 64*a* situated at the appropriate detection position so as to enter the light receiving device, and is turned off when none of the reflection plates 64*a* is in a proper detection position. As previously described, the detection signal becomes HIGH when the switch mechanism is turned on, and becomes LOW when the switch mechanism is turned off. In the case where the torque-transmission mechanism is comprised of a series of gears, the detection portion 64 as shown in FIG. 18 may be integrally formed with a gear which is fixedly attached to the end of the rotating rod 43*a*. Such a configuration can properly detect the rotation of the paper-ejection driving roller 43 by use of the roller sensor 51.

Figure 19:
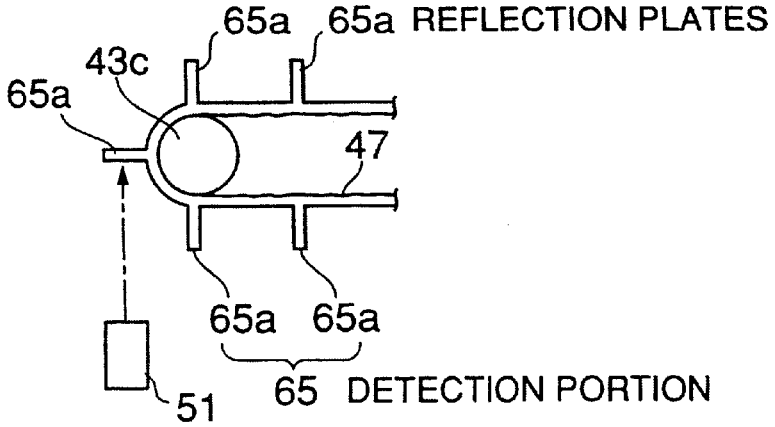
FIG. 19 is an illustrative drawing showing yet another example of the detection portion applicable to the stacker device of the second embodiment.

FIG. 19 is an illustrative drawing showing yet another example of the detection portion applicable to the stacker device of the second embodiment.

A detection portion 65 of FIG. 19 includes a plurality of reflection plates 65*a* outwardly extending from a surface of the belt 47 and provided at constant intervals in a longitudinal direction of the belt 47. The roller sensor 51 is positioned to face one of the reflection plates 65*a* when this reflection plate comes to an appropriate detection position. The switch mechanism inside the roller sensor 51 is turned on when light emitted from the light emitting device is reflected by one of the reflection plates 65*a* situated at the appropriate detection position so as to enter the light receiving device, and is turned off when none of the reflection plates 65*a* is in a proper detection position. As previously described, the detection signal becomes HIGH when the switch mechanism is turned on, and becomes LOW when the switch mechanism is turned off.

FIGS. 20 through 23 are illustrative drawings showing other examples of the detection portion and the roller sensor applicable to the stacker device of the second embodiment. In FIGS. 20 through 23, a roller sensor 71 is comprised of a micro-switch, and includes a detection lever 71*a* movably attached. The detection lever 71*a* is urged at all times in one direction so as to stay at an off-position shown by solid lines in the absence of an externally applied force. In the roller sensor 71, a switch mechanism is turned off when the detection lever 71*a* resides at the off-position, and is turned on when the detection lever 71*a* is moved to an on-position shown by dashed lines by an externally applied force. A detection signal output from the roller sensor 71 becomes HIGH when the switch is turned on, and becomes LOW when the switch is turned off.

Figure 20:
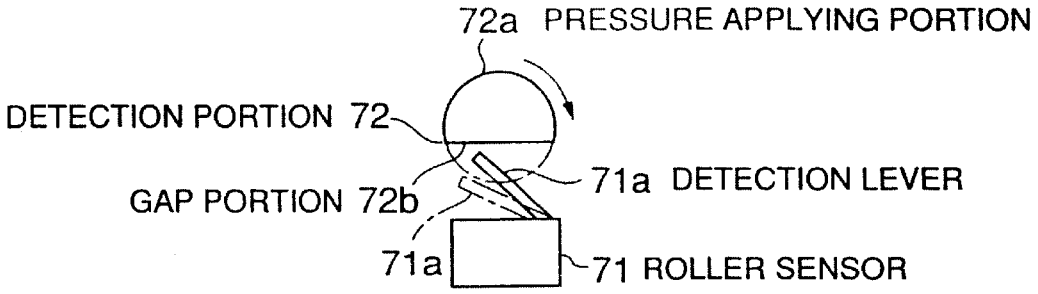
FIGS. 20 through 23 are illustrative drawings showing other examples of the detection portion and the roller sensor applicable to the stacker device of the second embodiment.

A detection portion 72 of FIG. 20 is provided as part of the rotating rod 43*a*, and includes a pressure applying portion 72*a* and a gap portion 72*b* which are formed by cutting off a portion of the rotating rod 43*a* with regard to a cross section thereof. The pressure applying portion 72*a* corresponds to a remaining circumferential surface, and the gap portion 72*b* is defined by a flat surface obtained after cutting off of the portion of the rotating rod 43*a*. The detection lever 71*a* is moved to the on-position by a pressure applied by the pressure applying portion 72*a* when a rotational position of the rotating rod 43*a* falls within a certain detection range. When the rotating rod 43*a* has a rotational position outside this detection range, on the other hand, a gap is created between the detection lever 71*a* and the rotating rod 43*a* because of presence of the gap portion 72*b*, so that the detection lever 71*a* returns to the off-position thereof. As can be understood, when the rotating rod 43*a* rotates, the detection lever 71*a* goes back and forth between the on-position and the off-position because of the pressure applying portion 72*a* and the gap portion 72*b*.

A detection portion 73 is formed as part of the elastic drum 43*b*, and includes two flat surfaces parallel to each other which are formed by cutting off respective portions of the elastic drum 43*b* with regard to a cross section thereof. These two flat surfaces define a pressure applying portion 73*a* and gap portions 73*b*. The detection lever 71*a* of the roller sensor 71 is moved to the on-position by a pressure applied by the pressure applying portion 73*a* when a rotational position of the rotating rod 43*a* falls within a certain detection range. When the rotating rod 43*a* has a rotational position outside this detection range, on the other hand, a gap is created between the detection lever 71*a* and the elastic drum 43*b* because of presence of the gap portions 73*b*, so that the detection lever 71*a* returns to the off-position thereof. As can be understood, when the elastic drum 43*b* rotates, the detection lever 71*a* goes back and forth between the on-position and the off-position because of the pressure applying portion 73*a* and the gap portions 73*b*.

Figure 22:
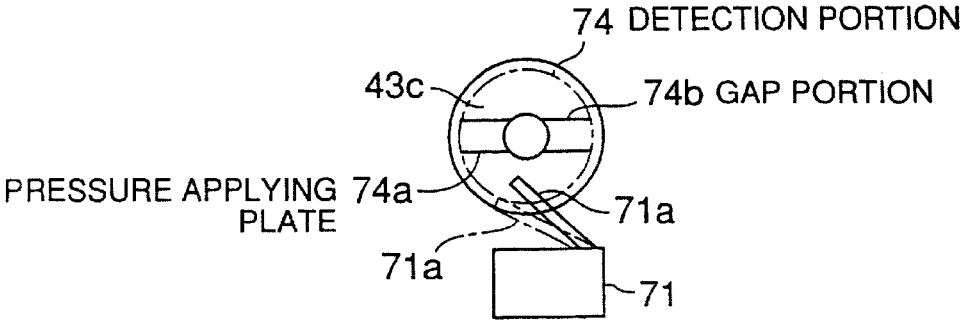
Figure 23:
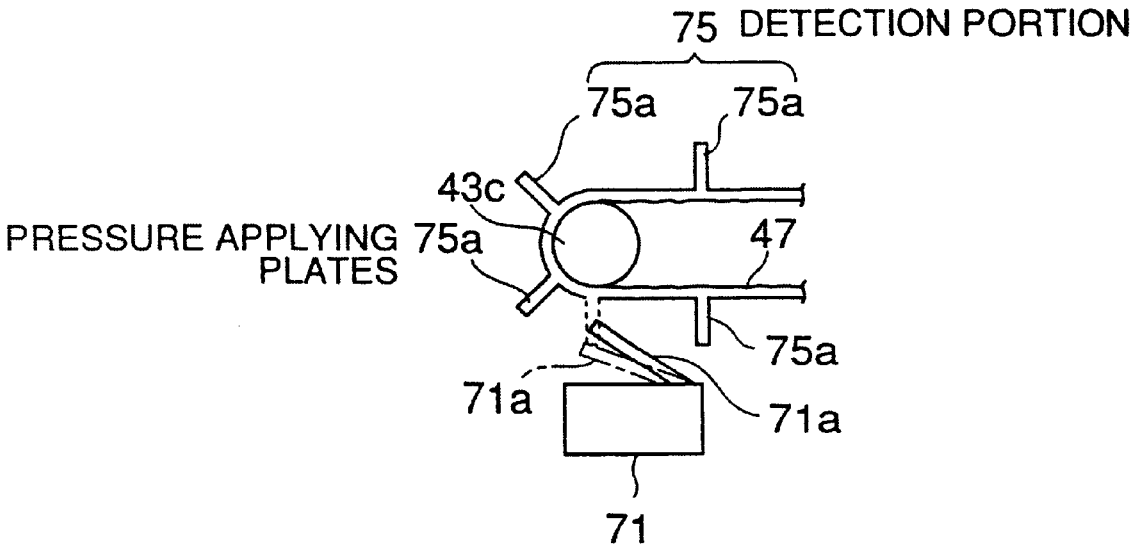

A detection portion 74 of FIG. 22 includes pressure applying plates 74*a* extending from a side surface of the pulley 43*c* along an extension of the rotating rod 43*a*. The detection lever 71*a* of the roller sensor 71 moves to the on-position thereof under a pressure applied by one of the pressure applying plates 74*a* when the pulley 43*c* has a rotational position thereof falling within a certain detection range. When the rotation position is outside this detection range, a gap is created between the detection lever 71*a* and the detection portion 74, so that the detection lever 71*a* goes back to the off-position thereof. As can be understood, when the pulley 43*c* rotates, the detection lever 71*a* goes back and forth between the on-position and the off-position because of movement of the pressure applying plates 74*a*. In the case where the torque-transmission mechanism is comprised of a series of gears, the detection portion 74 as shown in FIG. 22 may be integrally formed with a gear which is fixedly attached to the end of the rotating rod 43*a*. Such a configuration can properly detect the rotation of the paper-ejection driving roller 43 by use of the roller sensor 71.

Figure 21:
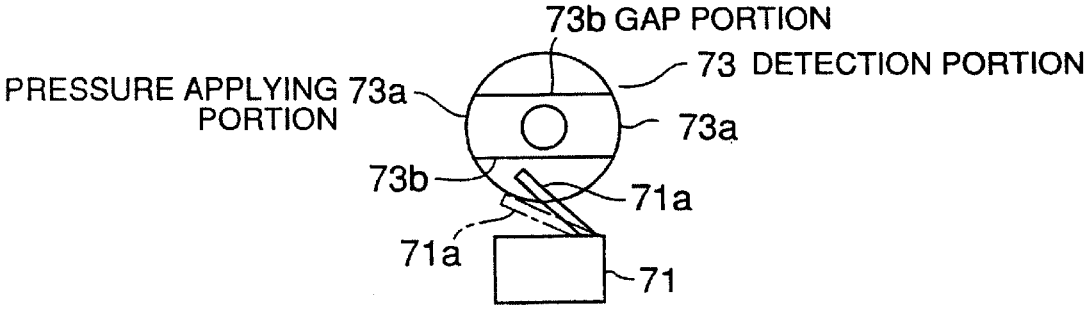

A detection portion 75 of FIG. 21 includes a plurality of pressure applying plates 75*a* outwardly extending from a surface of the belt 47 and provided at constant intervals in a longitudinal direction of the belt 47. The detection lever

71*a* of the roller sensor 71 moves to the on-position thereof under a pressure applied by one of the pressure applying plates 75*a* when the belt 47 has such a position in a travel direction thereof as fall within a certain detection range. When the position of the belt 47 is outside this detection range, none of the pressure applying plates 75*a* comes in contact with the detection lever 71*a*, so that the detection lever 71*a* goes back to the off-position thereof. As can be understood, when the belt 47 moves, the detection lever 71*a* goes back and forth between the on-position and the off-position because of movement of the pressure applying plates 75*a*.

According to the stacker device 30 of the second embodiment as described above, the paper sheets P ejected from the housing 1 of the facsimile device are carried by the conveyor belt 35, and are successively dropped in the paper storage C placed at the stack position. Even when no attendance is expected for a long period of time such as during a long vacation season, the paper sheets P would not be jammed from an excessive number of the paper sheets P being accumulated on the paper-ejection tray 15 so as to obstruct the following paper sheets ejected by the paper-ejection rollers 13.

Further, where the stacker-control unit 40 controls the stacker device 30, the stacker-control unit 40 initiates the motion of the conveyor belt 35 in synchronism with a timing at which the paper-ejection rollers 13 start rotation thereof, while obtaining this timing based on the detection signal supplied from the roller sensor 51 or 71. Also, the stacker-control unit 40 stops the conveyor belt 35 in synchronism with a timing at which the paper-ejection rollers 13 come to a halt. In this manner, the stacker-control unit 40, operating on its own under no control of the facsimile device, drives the conveyor belt 35 properly for a desired period of time. This configuration thus provides the stacker device 30 which has a wide variety of applicability, and is applicable to various types of facsimile devices.

The second embodiment has been described with reference to an example in which the driving roller 33 is subjected to a check as to whether it is rotating. Alternately, the paper-ejection passive roller 44 may be subject to the check. In this case, a detection portion may be provided as part of the rotating rod 44*a* or the elastic drum 44*b* of the paper-ejection passive roller 44, So that the roller sensor 51 or 71 detects optically or mechanically the rotation of the paper-ejection passive roller 44.

Further, the present invention is not limited to these embodiments, but various variations and modifications may be made without departing from the scope of the present invention.

What is claimed is:

1. A facsimile device comprising:

paper-ejection rollers which eject paper sheets from the facsimile device;

a roller sensor which detects rotation of said paper-ejection rollers; and a signal line which supplies a signal substantially indicative of a start time and an end time of the rotation of said paper-ejection rollers to an exterior of the facsimile device.

2. The facsimile device as claimed in claim 1, wherein said roller sensor includes an optical sensor emitting light and receiving returning light, said facsimile device further comprising means for reflecting the light emitted from said optical sensor so as to indicate the rotation of said paper-ejection rollers via changes in the returning light.

3. The facsimile device as claimed in claim 1, wherein said roller sensor includes an optical sensor emitting light and receiving returning light, said facsimile device further comprising a detection portion provided in association with one of said paper-ejection rollers and configured to reflect the light emitted from said optical sensor so as to indicate the rotation of said paper-ejection rollers via changes in the returning light.

4. The facsimile device as claimed in claim 3, wherein said detection portion has a first-reflectivity portion and a second-reflectivity portion arranged at different rotational positions with regard to the rotation of the one of said paper-ejection rollers, said first-reflectivity portion and said second-reflectivity portion modulating the returning light during the rotation of the one of said paper-ejection rollers.

5. The facsimile device as claimed in claim 3, wherein said detection portion has a non-circular cross section perpendicular to a rotation axis of the one of said paper-ejection rollers, an outline shape of said non-circular cross section modulating the returning light during the rotation of said paper-ejection rollers.

6. The facsimile device as claimed in claim 3, further comprising a belt which transfers a torque from said driving motor to the one of said paper-ejection rollers, wherein said detection portion includes a plurality of projections extending outwardly from a surface of said belt, said plurality of projections modulating the returning light during the rotation of the one of said paper-ejection rollers.

7. The facsimile device as claimed in claim 1, wherein said roller sensor includes a mechanical sensor having a movable part, a position of which is changed in association with rotation of the paper-ejection rollers, said facsimile device further comprising a detection portion provided in association with one of said paper-ejection rollers and configured to move the movable part so as to indicate the rotation of said paper-ejection rollers via changes in the position of the movable part.

8. The facsimile device as claimed in claim 7, wherein said detection portion has a non-circular cross section perpendicular to a rotation axis of the one of said paper-ejection rollers, an outline shape of said non-circular cross section prompting changes in the position of the movable part during the rotation of said paper-ejection rollers.

9. The facsimile device as claimed in claim 7, further comprising a belt which transfers a torque from said driving motor to the one of said paper-ejection rollers, wherein said detection portion includes a plurality of projections extending outwardly from a surface of said belt, said plurality of projections coming in contact with the movable part so as to change the position of the movable part during the rotation of the one of said paper-ejection rollers.

* * * * *